US008515295B2

(12) United States Patent
Groves

(10) Patent No.: US 8,515,295 B2
(45) Date of Patent: Aug. 20, 2013

(54) SYSTEM AND METHOD FOR INFORMING A CUSTOMER OF REMAINING LIFE IN A CUSTOMER REPLACEABLE UNIT DURING REPLACEMENT OF THE CUSTOMER REPLACEABLE UNIT

(75) Inventor: Peter Groves, Royston (GB)

(73) Assignee: Xerox Corporation, Norwalk, CT (US)

( * ) Notice: Subject to any disclaimer, the term of this patent is extended or adjusted under 35 U.S.C. 154(b) by 457 days.

(21) Appl. No.: 12/869,438

(22) Filed: Aug. 26, 2010

(65) Prior Publication Data

US 2012/0050052 A1 Mar. 1, 2012

(51) Int. Cl.
*G03G 15/08* (2006.01)

(52) U.S. Cl.
USPC ..... 399/27; 340/525; 340/540; 340/691.1; 399/9; 399/12; 399/13; 399/24; 399/25; 347/19

(58) Field of Classification Search
USPC ..... 340/525, 540, 691.1; 399/9, 12, 399/13, 24, 25, 27, 81, 110–113, 118–120, 399/262; 347/19
See application file for complete search history.

(56) References Cited

U.S. PATENT DOCUMENTS

| | | | | |
|---|---|---|---|---|
| 5,771,420 | A | 6/1998 | Suzuki et al. | |
| 6,295,423 | B1 | 9/2001 | Haines et al. | |
| 6,431,673 | B1 * | 8/2002 | Heim et al. | 347/9 |
| 6,856,418 | B2 | 2/2005 | Cheney | |
| 7,061,391 | B2 | 6/2006 | Hopper et al. | |
| 7,242,873 | B2 | 7/2007 | Saisu et al. | |
| 7,286,775 | B2 | 10/2007 | Utsumi et al. | |
| 7,526,215 | B2 | 4/2009 | Moodie et al. | |
| 7,595,908 | B2 | 9/2009 | Kai | |
| 2002/0188504 | A1 | 12/2002 | Whale | |
| 2003/0058297 | A1 * | 3/2003 | Saruta | 347/19 |
| 2004/0070642 | A1 * | 4/2004 | Murakami et al. | 347/19 |
| 2005/0172118 | A1 * | 8/2005 | Nasu | 713/156 |
| 2006/0083521 | A1 | 4/2006 | Simpson et al. | |
| 2007/0030296 | A1 * | 2/2007 | Yoshida et al. | 347/7 |
| 2009/0064015 | A1 | 3/2009 | You | |

* cited by examiner

*Primary Examiner* — Jennifer Mehmood
*Assistant Examiner* — Andrew Bee
(74) *Attorney, Agent, or Firm* — Maginot, Moore & Beck, LLP

(57) ABSTRACT

A system and method have been developed that enable a printer user to exhaust completely the useful life of a customer replaceable unit. The system and method also ensure that a user of the printer knows how to remove a persistent reorder message.

18 Claims, 2 Drawing Sheets

SYSTEM AND METHOD FOR INFORMING A CUSTOMER OF REMAINING LIFE IN A CUSTOMER REPLACEABLE UNIT DURING REPLACEMENT OF THE CUSTOMER REPLACEABLE UNIT

TECHNICAL FIELD

The system and method described in this document relate to printers that monitor an operational life of a customer replaceable unit, and more particularly, to printers that inform a user when a customer replaceable unit needs replacing.

BACKGROUND

Electronic printers are commonplace in home and office environments. These printers typically include a user interface that enables a user to enter commands to perform print jobs and to respond to queries generated by the printer. The user interface typically includes a screen for the display messages to and from the user. The user interface may be implemented using touch-screen technology alone or a user may also provide input with actuators, such as keys, mounted in proximity to the display of the interface.

Printers include an array of components, some of which are replaceable during the life of the printer. Some replaceable components should be removed and replaced only by certified customer service representatives. Other components, however, may be replaced by a customer without a service call being required. These components are commonly known as customer replaceable units (CRUs). One example of a customer replaceable unit is a drum maintenance unit in an offset printer. The drum maintenance unit includes a supply of release agent that is selectively applied to an intermediate imaging member in the printer to prepare a surface of the imaging member to receive ink from one or more printheads. A controller monitors the operational life of a CRU by counting the number of operations in which the CRU is involved. For example, the controller that operates the drum maintenance unit to engage and disengage the intermediate imaging member for the preparation of the imaging surface may count the number of imaging member revolutions during which a release agent applicator contacts the imaging surface. The controller compares this count to a maximum number of revolutions that the supply of release agent can support before the supply is exhausted. When the number of revolutions is within a predetermined range of the maximum number, the controller generates a message that is produced on the display to inform the user that the end of life for the drum maintenance unit is approaching. Typically, this message advises the user to order a replacement unit for installation in the printer.

When the replacement unit arrives, the user may proceed to remove the old unit and replace it with the new unit. Depending upon the promptness with which the user ordered the replacement unit and its delivery, some useful life may be left in the old unit. Moreover, the user may be incentivized to replace the unit because the message advising the customer to order the replacement unit may be persistently displayed and the user may tire of seeing the message. Consequently, the user may replace the old unit with the new unit to reset the message display and not wait unit the old unit is completely exhausted. Replacing the old unit with the new unit before it is completely or almost completely exhausted is not the most efficient use of old unit. Helping the user replace the old unit at a more optimal time is a desirable goal.

SUMMARY

A system has been developed that enables a printer user to exhaust completely the useful life of a customer replaceable unit. The system of the printer includes at least one replaceable module that is configured for installation and removal from a predetermined location within a printer. The system of the printer also includes a user interface positioned on the printer to be accessible by a user, the user interface including a display to provide indicia to a user. The system of the printer further includes an image processor located within the printer, the image processor being configured to count a usage parameter for the at least one replaceable module. The system of the printer further includes a controller operatively connected to the at least one replaceable module, the user interface, and to the image processor, the controller being configured to detect removal of the at least one replaceable module from the printer, compare the usage parameter from the image processor to a predetermined threshold for the at least one replaceable module, and generate a signal to operate the user interface and display indicia indicative of the at least one replaceable module having a remaining operational life in response to the detected removal of the at least one replaceable module and the usage parameter being less than the predetermined threshold.

A method has been developed that enables a printer user to exhaust completely the useful life of a customer replaceable unit. The method includes counting a usage parameter for at least one replaceable module. The method also includes detecting removal of the at least one replaceable module from a printer. The method further includes comparing a usage parameter to a first predetermined threshold for the at least one replaceable module. The method also includes generating a signal to operate a user interface and display indicia indicative of the at least one replaceable module having a remaining operational life in response to the detected removal of the at least one replaceable module and the usage parameter being less than the first predetermined threshold.

A method has been developed that enables a computer operatively connected to a printer to receive data from the printer. The method includes operatively connecting a computer to a printer. The method further includes receiving a usage parameter for a customer replaceable unit within the printer. The method also includes comparing with the computer the usage parameter received from the printer with a predefined threshold. The method further includes displaying on the computer a difference between the usage parameter and the predefined threshold.

DETAILED DESCRIPTION

Figure 1:
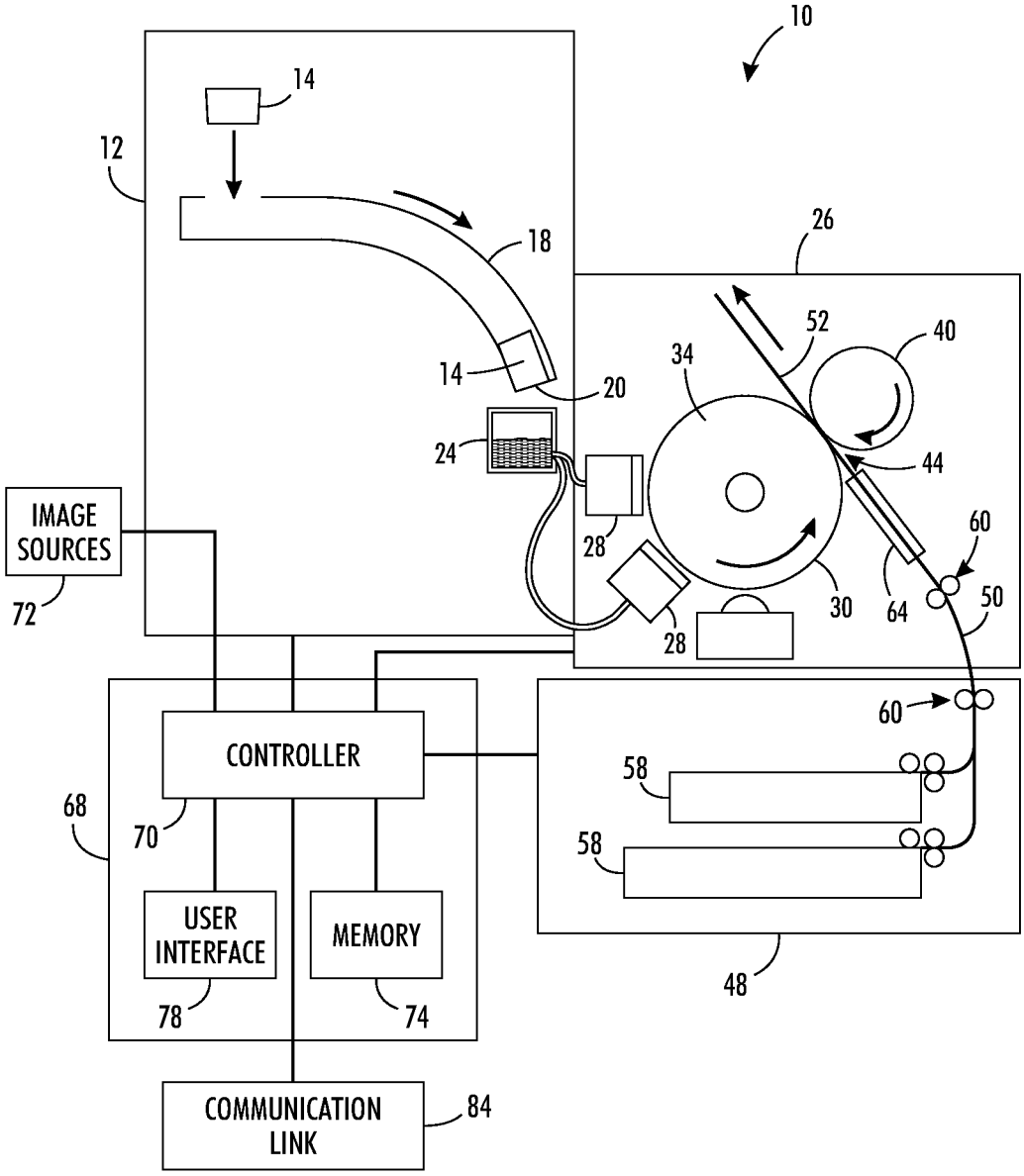
FIG. 1 is a schematic view of an embodiment of a phase change ink imaging device having an intermediate printing member and a control system.

FIG. 1 is a side schematic view of an embodiment of a phase change ink imaging device configured for indirect or offset printing using melted phase change ink. The device 10 of FIG. 1 includes an ink handling system 12, also referred to as an ink loader, which is configured to receive phase change ink in solid form, such as blocks of ink 14, which are commonly called ink sticks. The ink loader 12 includes feed channels 18 into which ink sticks 14 are inserted. Although a single feed channel 18 is visible in FIG. 1, the ink loader 12 includes a separate feed channel for each color or shade of color of ink stick 14 used in the device 10. The feed channel 18 guides ink sticks 14 toward a melting assembly 20 at one end of the channel 18 where the sticks are heated to a phase change ink melting temperature to melt the solid ink to form liquid ink. Any suitable melting temperature may be used depending on the phase change ink formulation. In one embodiment, the phase change ink melting temperature is approximately 100° C. to 140° C. The melted ink is received in a reservoir 24 configured to maintain a quantity of the melted ink for delivery to printing system 26 of the device 10.

The printing system 26 includes at least one printhead 28 having inkjets arranged to eject drops of melted ink onto a surface 30 of an intermediate imaging member 34. Two printheads are shown in FIG. 1 although any suitable number of printheads 28 may be used. Before the ink is ejected onto the intermediate imaging member surface 30, a layer or film of release agent is applied to the surface 30 by a release agent application assembly 38, which is also known as a drum maintenance unit (DMU). The rotating member 34 is shown as a drum in FIG. 1 although in alternative embodiments the rotating member 34 may comprise a rotating belt, band, roller or other similar type of structure. A transfix roller 40 is loaded against the imaging surface 30 of rotating member 34 to form a nip 44 through which sheets of recording media 52 are fed in timed registration with the ink images formed on the imaging surface 30 by the inkjets of the printhead 28. Pressure (and in some cases heat) is generated in the nip 44 that, in conjunction with the release agent that forms the imaging surface 30, facilitates the transfer of the ink images from the surface 30 to the recording media 52 while the release agent substantially prevents the ink from adhering to the rotating member 34.

The imaging device 10 includes a media supply and handling system 48 that is configured to transport recording media along a media path 50 defined in the device 10 that guides media through the nip 44, where the ink is transferred from the imaging surface 30 to the recording media 52. The media supply and handling system 48 includes at least one media source 58, although two such sources are shown in the figure. The supply trays 58 store and supply recording media of different types and sizes for the device 10. The media supply and handling system includes suitable mechanisms, such as rollers 60, which may be driven or idle rollers, as well as baffles, deflectors, and the like, for transporting media along the media path 50.

Media conditioning devices may be positioned along the media path 50 for controlling and regulating the temperature of the recording media so that the media arrives at the nip 44 at a suitable temperature to receive the ink from the imaging surface 30. For example, in the embodiment of FIG. 1, a preheating assembly 64 is provided along the media path 50 for bringing the recording media to an initial predetermined temperature prior to reaching the nip 44. The preheating assembly 64 may rely on contact, radiant, conductive, or convective heat to bring the media to a target preheat temperature, which in one practical embodiment, is in a range of about 30° C. to about 70° C. In alternative embodiments, other thermal conditioning devices may be used along the media path before, during, and after ink has been deposited onto the media for controlling media (and ink) temperatures.

Operation and control of the various subsystems, components and functions of the imaging device 10 are performed with the aid of a control system 68. The control system 68 is operatively connected to one or more image sources 72, such as a scanner system or a work station connection, to receive and manage image data from the sources and to generate control signals that are delivered to the components and subsystems of the printer. Some of the control signals are based on the image data and these signals cause the components and subsystems of the printer to perform various procedures and operations for producing images on media with the imaging device 10.

The control system 68 includes a controller 70, electronic storage or memory 74, and a user interface (UI) 78. The controller 70 comprises a processing device, such as a central processing unit (CPU), an application specific integrated circuit (ASIC), a field programmable gate array (FPGA) device, or a microcontroller. Among other tasks, the processing device processes images provided by the image sources 72. The one or more processing devices comprising the controller 70 are configured with programmed instructions that are stored in the memory 74. The controller 70 executes these instructions to operate the components and subsystems of the printer. Any suitable type of memory or electronic storage may be used. For example, the memory 74 may be a non-volatile memory, such as read only memory (ROM), or a programmable non-volatile memory, such as EEPROM or flash memory.

User interface (UI) 78 comprises a suitable input/output device located on the imaging device 10 that enables operator interaction with the control system 68. For example, UI 78 may include a keypad and display (not shown). The controller 70 is operatively connected to the user interface 78 to receive signals indicative of selections and other information input to the user interface 78 by a user or operator of the device. Controller 70 is operatively connected to the user interface 78 to display information to a user or operator including selectable options, machine status, consumable status, and the like. The controller 70 may also be coupled to a communication link 84, such as a computer network, for receiving image data and user interaction data from remote locations.

The controller 70 is operatively connected to the various systems and components of the device 10, such as the ink handling system 12, printing system 26, media handling system 48, release agent application assembly 38, media conditioning devices 50, and other devices and mechanisms 80 of the imaging device 10, and is configured by the programmed instructions and data stored in memory 74 to generate control signals that are output to these systems and devices. The control signals, for example, control the operating speeds, power levels, timing, actuation, and other parameters, of the system components to cause the imaging device 10 to operate in various states, modes, or levels of operation, that are denoted in this document collectively as operating modes. These operating modes include, for example, a startup or warm up mode, shutdown mode, various print modes, maintenance modes, and power saving modes.

The controller 70 is configured to monitor usage parameters associated with various components in the device 10. Some components may need to be replaced after a certain amount of use. The controller 70 tracks a usage parameter for each replaceable component and compares the usage parameter with a near end of life (NEOL) predetermined threshold for the component to determine if the component is near the end of its useful life. For replaceable components that require a customer service representative to perform the replacement, the controller may generate a message indicating a service call should be scheduled or that the machine is inoperable. For components that may be replaced by the user, the controller may generate a message on the user interface advising the customer to order a replacement unit. For example, the DMU 38 of the device 10 may begin to approach the end of the release agent supply and need to be replaced by a new DMU. The usage parameter monitored by the controller may be based on the number of media sheets imaged by the device 10 or on the number of revolutions of the rotating member 34 during which the roller of the DMU engaged the intermediate imaging member 34. The usage parameter may be based on other usage measurements, such as the number of ink drops ejected onto the rotating member 34 or the like. Upon detection that the usage parameter for a CRU has passed the NEOL threshold for the CRU, the controller 70 may generate indicia on the user interface 78 to alert the user to this condition and advise the customer to order a replacement CRU. These indicia are hereinafter referred to as "NEOL indicia". When a new CRU is available to the user, for various reasons, the user may be motivated to replace the old CRU with the new replacement CRU.

In previously known systems, no messages or indicia were generated in response to the removal of a CRU that had a usage parameter that was less than an end of life threshold. The system described in this document generates a message informing the user that useful life remains in the removed component. Additionally, the controller of the system described in this document generates indicia to direct the user on how to hide the NEOL or reorder component message by navigating through various menu steps. This second type of message is generated to address a possible reason that a user may wish to replace a CRU even though useful life remains in the removed unit.

Figure 2:
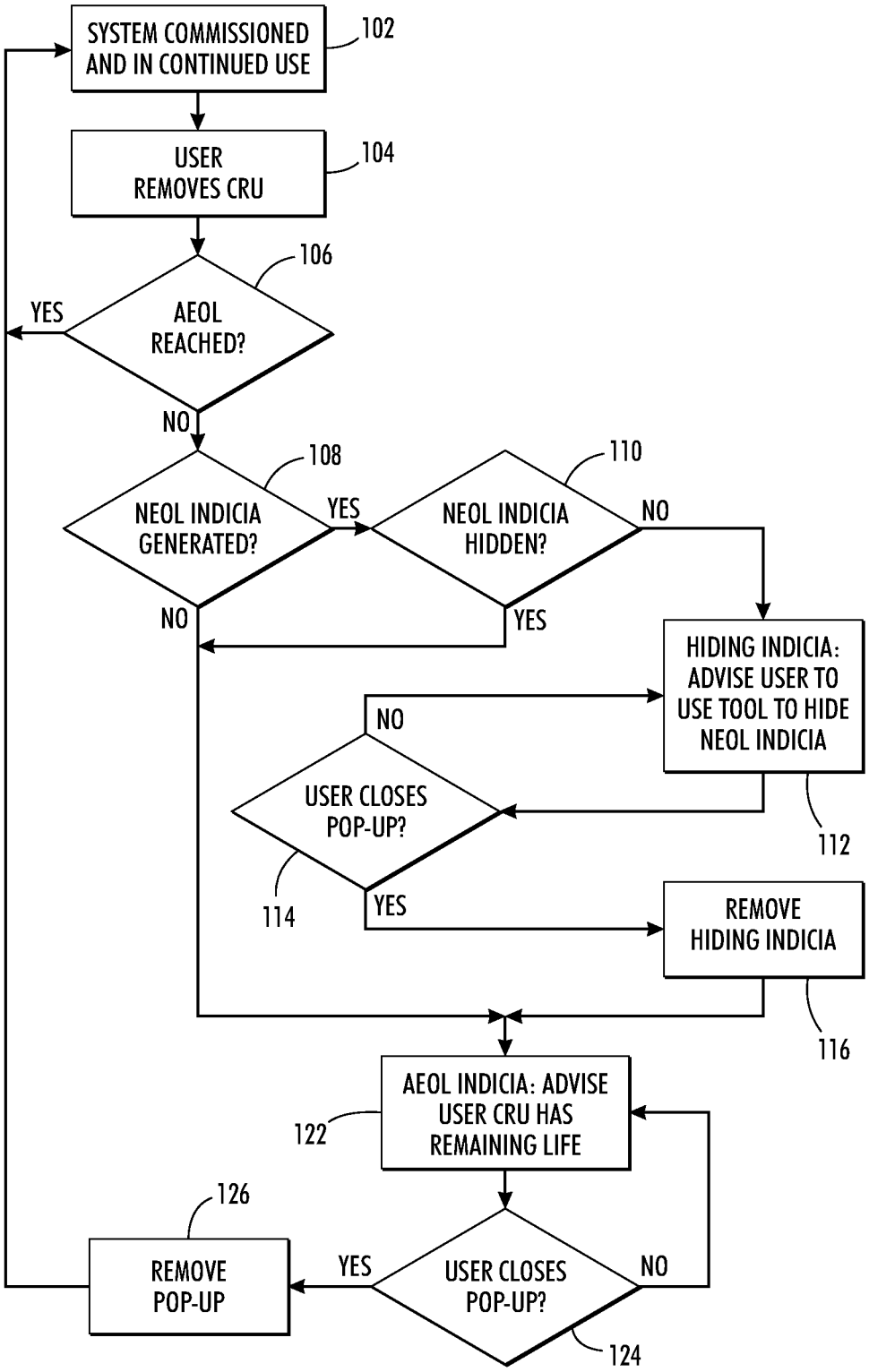
FIG. 2 is a flow chart of an exemplary set of instructions executed by the controller of FIG. 1.

Referring to FIG. 2, a flow chart 100 of an exemplary process implemented by the controller 70 is depicted. In that figure, the device 10 is shown as being capable of operation (block 102). Once the user removes a CRU, the controller 70 detects removal of the CRU (block 104). The controller determines whether the CRU has reached its actual end of life (AEOL) by comparing the usage parameter for the removed CRU with an AEOL predetermined threshold for the removed CRU (block 106). If the controller 70 determines the usage parameter for the CRU has reached or exceeded the AEOL threshold, the controller 70 remains in its current operational state (block 102).

In one embodiment, the controller 70 generates indicia to alert the user that the removed CRU has remaining life in response to the controller 70 determining the usage parameter for the removed CRU has not reached its AEOL threshold (i.e., the CRU has some remaining life). These indicia are hereinafter referred to as the "AEOL indicia". This processing is shown in block 122 of FIG. 2. After reviewing the message regarding the remaining life in the removed CRU, the user may be motivated to reinsert the old CRU and take advantage of the remaining life of the old CRU. In this embodiment, the controller continues to monitor and update the usage parameter for the returned CRU until the AEOL threshold is met or exceeded. The controller then generates a message for the user that a replacement CRU should be installed.

In the embodiment shown in FIG. 2, additional processing is performed before the controller generates the message regarding the existence of remaining life in the removed CRU. In this process, the controller 70 determines whether NEOL indicia have previously been generated in response to detection of a CRU being removed and the CRU has remaining life (block 108). If the controller 70 determines the NEOL indicia have been previously generated, the controller determines whether the user has already taken action to hide the NEOL indicia (block 110). If the user has not hidden the NEOL indicia, the controller generates indicia to inform the user that the NEOL indicia can be hidden in the event the user decides to place the old CRU with remaining life back into the device 10. These indicia are hereinafter referred to as the "hiding indicia". The controller awaits confirmation from the user that the user has seen the hiding indicia (block 114). Once the user provides the confirmation, the controller 70 removes the hiding indicia (block 116). The hiding indicia may include a button or other user manipulated actuator that a customer may use to display the process for hiding the NEOL indicia or the hiding indicia may include information about this process.

With the hiding indicia removed, the controller 70 generates the indicia to alert the user that the removed CRU has useful remaining life (block 122). The AEOL indicia may include an estimate of additional sheets of media that can be processed through the device 10 by extrapolating the actual end of life based on the usage parameter (examples of which are provided above) and the AEOL predetermined threshold. Once the controller 70 generates the AEOL indicia, the controller 70 waits for the user to acknowledge the AEOL indicia (block 124). Once the user has acknowledged the AEOL indicia, the controller 70 removes the AEOL indicia (block 126) and returns to its operational state (block 102). The user may now return the removed CRU to the printer and perform the menu steps to remove the NEOL indicia. The controller then continues to monitor and update the usage parameter for the returned CRU until the AEOL threshold is met or exceeded. The controller then generates a message for the user that a replacement CRU should be installed.

In one embodiment, the usage parameter may be stored in memory, e.g., a non-volatile memory, within a controller of the printer and also stored within a non-volatile memory of the CRU. A communication link between the CRU and the controller may be used by the controller to obtain the usage parameter from the CRU upon power up or upon insertion of the CRU into the printer. The controller may further be configured to update the non-volatile memory of the CRU with the value of the usage parameter stored in the memory of the controller. In addition, the controller and the CRU may be configured to store the predetermined thresholds associated with the NEOL and AEOL indicia in the respective memories.

During servicing of the printer, a technician may operatively connect a computer such as a handheld terminal, to the printer. The computer may then retrieve the usage parameter from the memory of the controller or form the non-volatile memory of the CRU. The computer then compares the usage parameter to one of the predetermined thresholds that triggers the NEOL and AEOL indicia and displays the appropriate indicia on the computer. This information enables the technician to determine whether the CRU has reached the AEOL threshold and is ready to be replaced. The computer may be configured with the predetermined thresholds in its memory or it may retrieve the predetermined thresholds that trigger the NEOL and AEOL indicia from the controller or the CRU. Furthermore, the computer may retrieve an extrapolated life expectancy of the CRU from the controller. Based on some or all of these data, the technician can decide whether to replace the CRU.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

I claim:

1. A printer comprising:

at least one replaceable module that is configured for installation and removal from a predetermined location within a printer;

a user interface positioned on the printer to be accessible by a user, the user interface including a display to provide indicia to a user;

an image processor located within the printer, the image processor being configured to count a usage parameter for the at least one replaceable module; and a controller operatively connected to the at least one replaceable module, the user interface, and to the image processor, the controller being configured to detect removal of the at least one replaceable module from the printer, compare the usage parameter from the image processor to a predetermined threshold for the at least one replaceable module, and generate a signal to operate the user interface and display indicia indicative of the at least one replaceable module having a remaining operational life in response to the detected removal of the at least one replaceable module and the usage parameter being less than the predetermined threshold.

2. The printer of claim 1, the controller being further configured to detect placement of at least one replaced replaceable module, and to monitor and update the usage parameter in response to the detected placement of the at least one replaced replaceable module.

3. The printer of claim 1, the user interface being configured to display data regarding termination of status indicia in response to the signal generated by the controller.

4. The printer of claim 1 wherein the status indicia identifies a user interface function configured to enable user termination of the status indicia.

5. The printer of claim 1 wherein the at least one replaceable module is a drum maintenance unit and the printer is a solid ink printer.

6. The printer of claim 1 wherein the usage parameter corresponds to a number of media sheets printed by the printer.

7. The printer of claim 1 wherein the usage parameter corresponds to a number of ink drops ejected onto an imaging member in the printer.

8. The printer of claim 5 wherein the usage parameter corresponds to a number of revolutions of an imaging member in the printer during which the drum maintenance unit applied release agent to the imaging member.

9. A method for alerting a user of remaining life of a replaceable unit in a printer, comprising:

counting a usage parameter for at least one replaceable module;

detecting removal of the at least one replaceable module from a printer;

comparing a usage parameter to a first predetermined threshold for the at least one replaceable module; and generating a signal to operate a user interface and display indicia indicative of the at least one replaceable module having a remaining operational life in response to the detected removal of the at least one replaceable module and the usage parameter being less than the first predetermined threshold.

10. The method of claim 9, further comprising:

detecting placement of at least one replaced replaceable module from the printer.

11. The method of claim 10 further comprising:

monitoring and updating the usage parameter in response to the detected placement of the at least one replaced replaceable module.

12. The method of claim 9, further comprising:

comparing the usage parameter to a second predetermined threshold for the at least one replaceable module; and generating a signal to operate the user interface and display a status indicia indicative of the at least one replaceable module having a remaining operational life in response to the usage parameter being less than the second predetermined threshold.

13. The method of claim 12, further comprising:

displaying data regarding termination of status indicia.

14. The method of claim 13 wherein the data regarding the status indicia identifies a user interface function configured to enable user termination of the status indicia.

15. The method of claim 9 wherein the at least one replaceable module is a drum maintenance unit and the printer is a solid ink printer.

16. The method of claim 9 wherein the usage parameter corresponds to a number of media sheets printed by the printer.

17. The printer of claim 9 wherein the usage parameter corresponds to a number of ink drops ejected onto an imaging member in the printer.

18. The method of claim 15 wherein the usage parameter corresponds to a number of revolutions of an imaging member in the printer during which the drum maintenance unit applied release agent to the imaging member.

* * * * *